US008141547B2

(12) United States Patent
Bednar et al.

(10) Patent No.: US 8,141,547 B2
(45) Date of Patent: Mar. 27, 2012

(54) CROSSBOW ANGLED GRIP

(75) Inventors: Richard L. Bednar, Munroe Falls, OH (US); Michael J. Shaffer, Mogadore, OH (US)

(73) Assignee: Hunter's Manufacturing Company, Inc., Suffield, OH (US)

( * ) Notice: Subject to any disclaimer, the term of this patent is extended or adjusted under 35 U.S.C. 154(b) by 0 days.

(21) Appl. No.: 12/759,881

(22) Filed: Apr. 14, 2010

(65) Prior Publication Data

US 2010/0186728 A1 Jul. 29, 2010

Related U.S. Application Data

(63) Continuation-in-part of application No. 11/489,773, filed on Jul. 20, 2006, now Pat. No. 7,661,418.

(60) Provisional application No. 60/700,876, filed on Jul. 20, 2005.

(51) Int. Cl.
*F41B 5/12* (2006.01)

(52) U.S. Cl. ..... 124/25

(58) Field of Classification Search ..... 124/25, 124/86, 88

See application file for complete search history.

(56) References Cited

U.S. PATENT DOCUMENTS

| | | | | |
|---|---|---|---|---|
| 859,932 | A | | 7/1907 | Edwards |
| 1,037,486 | A | | 9/1912 | Johnson |
| 2,312,150 | A | | 2/1943 | Conner |
| 2,674,822 | A | | 4/1954 | Studler |
| 2,965,994 | A | | 12/1960 | Sullivan |
| 2,981,154 | A | | 4/1961 | Sweeney |
| 3,090,150 | A | | 5/1963 | Stoner |
| 3,224,427 | A | * | 12/1965 | Ronan ..... 124/25 |
| 3,242,917 | A | | 3/1966 | Benedict |
| 3,641,691 | A | | 2/1972 | Ellis et al. |
| 4,258,689 | A | | 3/1981 | Barnett |
| 4,536,982 | A | | 8/1985 | Bredbury et al. |
| 4,663,875 | A | | 5/1987 | Tatro |
| 4,711,228 | A | * | 12/1987 | Gillespie ..... 124/25 |
| 4,733,489 | A | | 3/1988 | Kurak |
| D300,161 | S | | 3/1989 | Baldus et al. |
| 5,010,676 | A | | 4/1991 | Kennedy |
| 5,103,714 | A | | 4/1992 | LaFrance |
| 5,198,600 | A | | 3/1993 | E'Nama |
| 5,343,650 | A | | 9/1994 | Swan |
| 5,590,484 | A | | 1/1997 | Mooney et al. |
| 5,630,405 | A | | 5/1997 | Nizov |
| 5,826,363 | A | | 10/1998 | Olson |
| 5,842,460 | A | * | 12/1998 | Barber ..... 124/88 |
| 5,930,935 | A | | 8/1999 | Griffin |
| 6,134,823 | A | | 10/2000 | Griffin |
| 6,293,040 | B1 | | 9/2001 | Luth |
| 6,381,895 | B1 | | 5/2002 | Keeney et al. |
| 6,449,893 | B2 | | 9/2002 | Spinner |
| 6,609,321 | B2 | | 8/2003 | Faifer |
| D486,547 | S | | 2/2004 | Faifer |
| 6,705,304 | B1 | | 3/2004 | Pauluhn |
| 6,836,990 | B2 | | 1/2005 | Shiloni |
| 6,868,845 | B1 | | 3/2005 | Moore |

* cited by examiner

*Primary Examiner* — John Ricci

(74) *Attorney, Agent, or Firm* — Brouse McDowell; Stephen J. Presutti

(57) ABSTRACT

An angled grip may allow a wrist, a palm, and a forearm of an associated user to be substantially aligned when aiming or discharging a weapon. The angled grip may be selectively attachable to the weapon and may comprise a ball joint mount for operatively connecting the angled grip to a weapon. The ball joint mount may comprise a shaft and a spherical portion. The shaft can be fixedly received in a stock of the weapon. The spherical portion can be rotatably received in a socket formed in an end of the angled grip.

18 Claims, 18 Drawing Sheets

CROSSBOW ANGLED GRIP

This application is a continuation-in-part application of, and claims priority to, U.S. Ser. No. 11/489,773, titled CROSSBOW GRIP GUARD, filed Jul. 20, 2006 now U.S. Pat. No. 7,661,418, which is incorporated herein by reference, and which claims priority from a provisional patent application having U.S. Ser. No. 60/700,876, filed on Jul. 20, 2005.

I. BACKGROUND

A. Field of Invention

This invention pertains to the art of methods and apparatuses for safely discharging a crossbow device. This invention more specifically pertains to a safety device that maintains the fingers of the operator in a safe position during discharge of the crossbow device. This invention also more specifically pertains to a crossbow grip guard that aids the operator in maintaining proper finger orientation and proper holding of a crossbow in aiming and discharging the crossbow.

B. Description of the Related Art

It is known in the art to draw back the bowstring for a crossbow device. Since crossbows propel the bolts there from with the force of the bowstring, a substantial bowstring force is needed to accurately target the intended game. As a result, during discharge of the crossbow the force is exerted on the projectile through the bowstring.

It is also known that during discharge of the cross bow and bowstring respectively certain associated operator's have placed a thumb or finger in the path of the moving bowstring, causing injury to the associated operator's appendage.

What is needed then is a crossbow hand grip that aids the user in maintaining proper finger orientation and proper holding of a crossbow while aiming and discharging the crossbow while also allowing the user to grip the crossbow in a natural and comfortable manner

II. SUMMARY

According to one embodiment of the invention, a crossbow may comprise a stock having a first stock end and a second stock end; a crossbar fixedly connected to the first stock end, wherein the crossbar comprises a first crossbar end and a second crossbar end that define a first axis that extends substantially perpendicular to a longitudinal axis of the stock; a bowstring operatively connected between the first crossbar end and the second crossbar end; a trigger mechanism that allows for the selective retention and release of the bowstring; and, an angled grip operatively connected to the stock. The angled grip may allow a wrist, a palm, and a forearm of an associated user to be substantially aligned when aiming or discharging the crossbow.

According to another embodiment of the invention, a crossbow may comprise a stock having a first stock end and a second stock end; a crossbar fixedly connected to the first stock end, wherein the crossbar comprises a first crossbar end and a second crossbar end that define a first axis that extends substantially perpendicular to a longitudinal axis of the stock; a bowstring operatively connected between the first crossbar end and the second crossbar end; a trigger mechanism that allows for the selective retention and release of the bowstring; and, an angled grip operatively connected to the stock. The angled grip may allow a wrist, a palm, and a forearm of an associated user to be substantially aligned when aiming or discharging the crossbow. The angled grip may be selectively adjustable between a first position and a second position, wherein the second position comprises an angled-grip position that allows the wrist, the palm, and the forearm of the associated user to be substantially aligned when aiming or discharging the crossbow.

According to another embodiment of the invention, a crossbow may comprise a stock having a first stock end and a second stock end; a crossbar fixedly connected to the first stock end, wherein the crossbar comprises a first crossbar end and a second crossbar end that define a first axis that extends substantially perpendicular to a longitudinal axis of the stock; a bowstring operatively connected between the first crossbar end and the second crossbar end; a trigger mechanism that allows for the selective retention and release of the bowstring; and, an angled grip operatively connected to the stock. The angled grip may allow a wrist, a palm, and a forearm of an associated user to be substantially aligned when aiming or discharging the crossbow. The angled grip may be pivotally attached to the crossbow.

According to another embodiment of the invention, a crossbow may comprise a stock having a first stock end and a second stock end; a crossbar fixedly connected to the first stock end, wherein the crossbar comprises a first crossbar end and a second crossbar end that define a first axis that extends substantially perpendicular to a longitudinal axis of the stock; a bowstring operatively connected between the first crossbar end and the second crossbar end; a trigger mechanism that allows for the selective retention and release of the bowstring; and, an angled grip operatively connected to the stock. The angled grip may allow a wrist, a palm, and a forearm of an associated user to be substantially aligned when aiming or discharging the crossbow. The angled grip may be pivotally attached to the crossbow. The angled grip may further comprise a ball joint mount having a first end operatively connected to the stock and a second end operatively connected to the angled grip. The ball joint mount may comprise a shaft fixedly received in the stock and a spherical portion rotatably received in a socket formed in an end of the angled grip.

According to another embodiment of the invention, a crossbow may comprise a stock having a first stock end and a second stock end; a crossbar fixedly connected to the first stock end, wherein the crossbar comprises a first crossbar end and a second crossbar end that define a first axis that extends substantially perpendicular to a longitudinal axis of the stock; a bowstring operatively connected between the first crossbar end and the second crossbar end; a trigger mechanism that allows for the selective retention and release of the bowstring; and, an angled grip operatively connected to the stock. The angled grip may allow a wrist, a palm, and a forearm of an associated user to be substantially aligned when aiming or discharging the crossbow. The angled grip may be pivotally attached to the crossbow. The angled grip may further comprise a ball joint mount having a first end operatively connected to the stock and a second end operatively connected to the angled grip. The ball joint mount may comprise a shaft fixedly received in the stock and a spherical portion rotatably received in a socket formed in an end of the angled grip. The crossbow may also comprise a quick attach member for selectively attaching the angled grip to the ball joint mount.

According to another embodiment of the invention, a crossbow may comprise a stock having a first stock end and a second stock end; a crossbar fixedly connected to the first stock end, wherein the crossbar comprises a first crossbar end and a second crossbar end that define a first axis that extends substantially perpendicular to a longitudinal axis of the stock; a bowstring operatively connected between the first crossbar end and the second crossbar end; a trigger mechanism that allows for the selective retention and release of the bowstring;

and, an angled grip operatively connected to the stock. The angled grip may allow a wrist, a palm, and a forearm of an associated user to be substantially aligned when aiming or discharging the crossbow. The angled grip may be pivotally attached to the crossbow. The angled grip may further comprise a ball joint mount having a first end operatively connected to the stock and a second end operatively connected to the angled grip. The ball joint mount may comprise a shaft fixedly received in the stock and a spherical portion rotatably received in a socket formed in an end of the angled grip. The shaft of the ball joint mount may comprise a first plurality of threads that can be received by a second plurality of threads form in the stock.

According to another embodiment of the invention, a crossbow may comprise a stock having a first stock end and a second stock end; a crossbar fixedly connected to the first stock end, wherein the crossbar comprises a first crossbar end and a second crossbar end that define a first axis that extends substantially perpendicular to a longitudinal axis of the stock; a bowstring operatively connected between the first crossbar end and the second crossbar end; a trigger mechanism that allows for the selective retention and release of the bowstring; and, an angled grip operatively connected to the stock. The angled grip may allow a wrist, a palm, and a forearm of an associated user to be substantially aligned when aiming or discharging the crossbow. The angled grip may be pivotally attached to the crossbow. The angled grip may further comprise a ball joint mount having a first end operatively connected to the stock and a second end operatively connected to the angled grip. The ball joint mount may comprise a shaft fixedly received in the stock and a spherical portion rotatably received in a socket formed in an end of the angled grip. The shaft of the ball joint mount may comprise a first plurality of threads that can be received by a second plurality of threads form in the stock. The second plurality of threads may be exposed by the removal of a sling swivel stud that may be attached to the stock.

According to one embodiment of the invention, a crossbow may comprise a stock having a first stock end and a second stock end; a crossbar fixedly connected to the first stock end, wherein the crossbar comprises a first crossbar end and a second crossbar end that define a first axis that extends substantially perpendicular to a longitudinal axis of the stock; a bowstring operatively connected between the first crossbar end and the second crossbar end; a trigger mechanism that allows for the selective retention and release of the bowstring; and, an angled grip operatively connected to the stock. The angled grip may allow a wrist, a palm, and a forearm of an associated user to be substantially aligned when aiming or discharging the crossbow. The crossbow may further comprise a support member attached to an end of the angled grip and having substantially a v-shape. The support member may comprise a first arm and a second arm that define a support surface for supporting the crossbow; and, a cylindrical base having a first plurality of threads that are received by a second plurality of threads on the end of the angled grip.

According to another embodiment of the invention, a crossbow may comprise a stock having a first stock end and a second stock end; a crossbar fixedly connected to the first stock end, wherein the crossbar comprises a first crossbar end and a second crossbar end that define a first axis that extends substantially perpendicular to a longitudinal axis of the stock; a bowstring operatively connected between the first crossbar end and the second crossbar end; a trigger mechanism that allows for the selective retention and release of the bowstring; and, an angled grip operatively connected to the stock. The angled grip may allow a wrist, a palm, and a forearm of an associated user to be substantially aligned when aiming or discharging the crossbow. The crossbow may further comprise a mounting bracket attached to the stock. The mounting bracket may comprise a first connection location that operatively connects the angled grip to the crossbow.

According to another embodiment of the invention, a crossbow may comprise a stock having a first stock end and a second stock end; a crossbar fixedly connected to the first stock end, wherein the crossbar comprises a first crossbar end and a second crossbar end that define a first axis that extends substantially perpendicular to a longitudinal axis of the stock; a bowstring operatively connected between the first crossbar end and the second crossbar end; a trigger mechanism that allows for the selective retention and release of the bowstring; and, an angled grip operatively connected to the stock. The angled grip may allow a wrist, a palm, and a forearm of an associated user to be substantially aligned when aiming or discharging the crossbow. The crossbow may further comprise a mounting bracket attached to the stock. The mounting bracket may comprise a first connection location that operatively connects the angled grip to the crossbow. The crossbow may also comprise a ball joint mount comprising a shaft and a spherical portion. The first connection location may comprise an opening that may receive a first end of the shaft. The spherical portion may be rotatably received in a socket formed in an end of the angled grip.

According to another embodiment of the invention, a crossbow may comprise a stock having a first stock end and a second stock end; a crossbar fixedly connected to the first stock end, wherein the crossbar comprises a first crossbar end and a second crossbar end that define a first axis that extends substantially perpendicular to a longitudinal axis of the stock; a bowstring operatively connected between the first crossbar end and the second crossbar end; a trigger mechanism that allows for the selective retention and release of the bowstring; and, an angled grip operatively connected to the stock. The angled grip may allow a wrist, a palm, and a forearm of an associated user to be substantially aligned when aiming or discharging the crossbow. The crossbow may further comprise a mounting bracket attached to the stock. The mounting bracket may comprise a first connection location that operatively connects the angled grip to the crossbow. The mounting bracket may further comprise a second connection location for use in operatively connecting the angled grip to the crossbow.

According to another embodiment of the invention, a crossbow may comprise a stock having a first stock end and a second stock end; a crossbar fixedly connected to the first stock end, wherein the crossbar comprises a first crossbar end and a second crossbar end that define a first axis that extends substantially perpendicular to a longitudinal axis of the stock; a bowstring operatively connected between the first crossbar end and the second crossbar end; a trigger mechanism that allows for the selective retention and release of the bowstring; and, an angled grip operatively connected to the stock. The angled grip may allow a wrist, a palm, and a forearm of an associated user to be substantially aligned when aiming or discharging the crossbow. The crossbow may further comprise a mounting bracket attached to the stock. The mounting bracket may comprise a first connection location that operatively connects the angled grip to the crossbow. The mounting bracket may further comprise a second connection location for use in operatively connecting the angled grip to the crossbow. The mounting bracket may also comprise a third connection location having an opening adapted to receive a sling swivel stud.

According to another embodiment of the invention, a crossbow may comprise a stock having a first stock end and a second stock end; a crossbar fixedly connected to the first stock end, wherein the crossbar comprises a first crossbar end and a second crossbar end that define a first axis that extends substantially perpendicular to a longitudinal axis of the stock; a bowstring operatively connected between the first crossbar end and the second crossbar end; a trigger mechanism that allows for the selective retention and release of the bowstring; and, an angled grip operatively connected to the stock. The angled grip may allow a wrist, a palm, and a forearm of an associated user to be substantially aligned when aiming or discharging the crossbow. The angled grip may further comprise a moldable composition. The moldable composition may allow the angled grip to be molded to substantially conform to a shape of a hand of the associated user when heated to a first temperature within a predetermined temperature range and the moldable composition may retain the shape of the hand when cooled to a second temperature that is below the predetermined temperature range.

According to another embodiment of the invention, a crossbow may comprise a stock having a first stock end and a second stock end; a crossbar fixedly connected to the first stock end, wherein the crossbar comprises a first crossbar end and a second crossbar end that define a first axis that extends substantially perpendicular to a longitudinal axis of the stock; a bowstring operatively connected between the first crossbar end and the second crossbar end; a trigger mechanism that allows for the selective retention and release of the bowstring; and, an angled grip operatively connected to the stock. The angled grip may allow a wrist, a palm, and a forearm of an associated user to be substantially aligned when aiming or discharging the crossbow. The angled grip may further comprise a moldable composition and a rigid core. The moldable composition may allow the angled grip to be molded to substantially conform to a shape of a hand of the associated user when heated to a first temperature within a predetermined temperature range and the moldable composition may retain the shape of the hand when cooled to a second temperature that is below the predetermined temperature range. The moldable composition may be applied substantially completely over the rigid core and the rigid core may provide structural support substantially throughout the length of the angled grip during the time the moldable composition is heated to the first temperature and after the moldable composition is cooled to the second temperature.

According to one embodiment of the invention, an angled grip may comprise a ball joint mount for operatively connecting the angled grip to a weapon. The ball joint mount may comprise a shaft that can be fixedly received in a stock of the weapon; and, a spherical portion rotatably received in a socket formed in an end of the angled grip. The angled grip may allow a wrist, a palm, and a forearm of an associated user to be substantially aligned when aiming or discharging the weapon.

According to another embodiment of the invention, an angled grip may comprise a ball joint mount for operatively connecting the angled grip to a weapon. The ball joint mount may comprise a shaft that can be fixedly received in a stock of the weapon; and, a spherical portion rotatably received in a socket formed in an end of the angled grip. The angled grip may allow a wrist, a palm, and a forearm of an associated user to be substantially aligned when aiming or discharging the weapon. The angled grip may further comprise a mounting bracket. The mounting bracket can be attached to the stock of the weapon and may comprise a first connection location having a first opening that can receive the shaft of the ball joint mount for operatively connecting the angled grip to the weapon.

According to one embodiment of the invention, a method may comprise the steps of providing a crossbow having a stock having a first stock end and a second stock end; a crossbar fixedly connected to the first stock end, wherein the crossbar comprises a first crossbar end and a second crossbar end that define a first axis that extends substantially perpendicular to a longitudinal axis of the stock; a bowstring operatively connected between the first crossbar end and the second crossbar end; a trigger mechanism that allows for the selective retention and release of the bowstring; and, a grip for allowing an associated user to securely grasp the crossbow during operation of the crossbow; adjusting the grip from a first position to a second position, wherein the second position allows a wrist, a palm, and a forearm of the associated user to be substantially aligned when aiming or discharging the crossbow; aiming the crossbow; and, firing the crossbow.

According to one embodiment of the invention, a method may comprise the steps of providing a crossbow having a stock having a first stock end and a second stock end; a crossbar fixedly connected to the first stock end, wherein the crossbar comprises a first crossbar end and a second crossbar end that define a first axis that extends substantially perpendicular to a longitudinal axis of the stock; a bowstring operatively connected between the first crossbar end and the second crossbar end; a trigger mechanism that allows for the selective retention and release of the bowstring; and, a grip for allowing an associated user to securely grasp the crossbow during operation of the crossbow; adjusting the grip from a first position to a second position, wherein the second position allows a wrist, a palm, and a forearm of the associated user to be substantially aligned when aiming or discharging the crossbow; operatively connecting the grip to the crossbow, wherein the grip comprises a ball joint mount having a shaft that can be fixedly received in the stock of the crossbow and a spherical portion rotatably received in a socket formed in an end of the grip; aiming the crossbow; and, firing the crossbow.

According to one embodiment of the invention, a method may comprise the steps of providing a crossbow having a stock having a first stock end and a second stock end; a crossbar fixedly connected to the first stock end, wherein the crossbar comprises a first crossbar end and a second crossbar end that define a first axis that extends substantially perpendicular to a longitudinal axis of the stock; a bowstring operatively connected between the first crossbar end and the second crossbar end; a trigger mechanism that allows for the selective retention and release of the bowstring; and, a grip for allowing an associated user to securely grasp the crossbow during operation of the crossbow; adjusting the grip from a first position to a second position, wherein the second position allows a wrist, a palm, and a forearm of the associated user to be substantially aligned when aiming or discharging the crossbow; removing a sling swivel stud attached to the stock of the crossbow to reveal a first plurality of threads; operatively connecting the grip to the crossbow, wherein the grip comprises a ball joint mount having a shaft comprising a second plurality of threads that can be received in the first plurality of threads and a spherical portion rotatably received in a socket formed in an end of the grip; aiming the crossbow; and, firing the crossbow.

According to one embodiment of the invention, a method may comprise the steps of providing a crossbow having a stock having a first stock end and a second stock end; a crossbar fixedly connected to the first stock end, wherein the crossbar comprises a first crossbar end and a second crossbar end that define a first axis that extends substantially perpendicular to a longitudinal axis of the stock; a bowstring operatively connected between the first crossbar end and the second crossbar end; a trigger mechanism that allows for the selective retention and release of the bowstring; and, a grip for allowing an associated user to securely grasp the crossbow during operation of the crossbow; adjusting the grip from a first position to a second position, wherein the second position allows a wrist, a palm, and a forearm of the associated user to be substantially aligned when aiming or discharging the crossbow; operatively connecting the grip to the crossbow, wherein the grip comprises a quick attach member comprising a plug and a first socket; and, a ball joint mount comprising a shaft and a spherical portion, wherein the shaft can be fixedly received in the stock of the crossbow and a spherical portion rotatably received in the first socket of the quick attach member and the plug is received in a socket formed in an end of the grip; aiming the crossbow; and, firing the crossbow.

One advantage of this invention is that the user may assume a more comfortable and natural grip when aiming and discharging the crossbow.

Still other benefits and advantages of the invention will become apparent to those skilled in the art to which it pertains upon a reading and understanding of the following detailed specification.

III. BRIEF DESCRIPTION OF THE DRAWINGS

The invention may take physical form in certain parts and arrangement of parts, a preferred embodiment of which will be described in detail in this specification and illustrated in the accompanying drawings which form a part hereof and wherein.

IV. DETAILED DESCRIPTION

Figure 1:
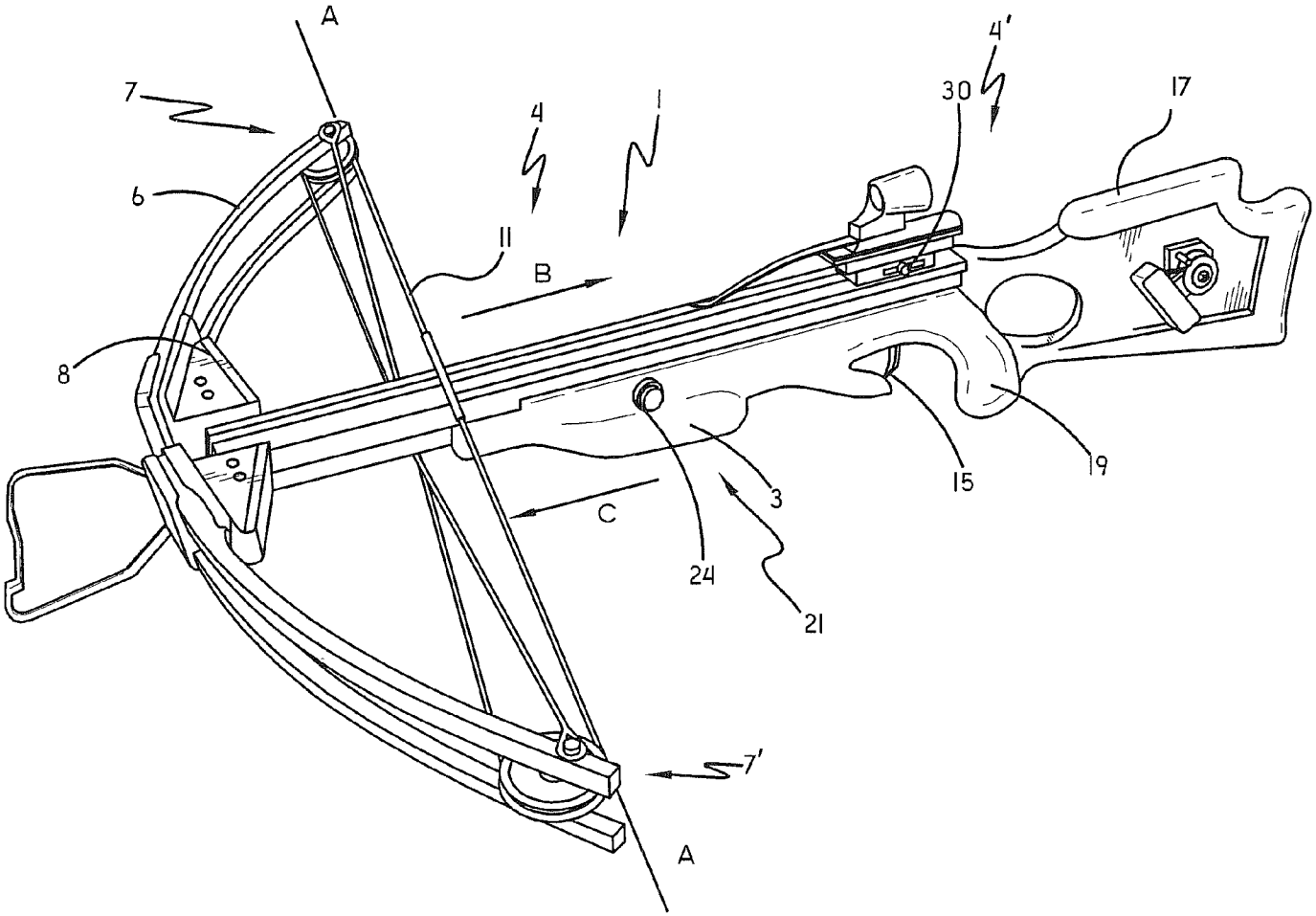
FIG. 1 shows a perspective angled-side view of a crossbow having a stock safety device according to one embodiment of the invention.

Referring now to the drawings wherein the showings are for purposes of illustrating embodiments of the invention only and not for purposes of limiting the same, FIG. 1 shows a crossbow depicted generally at 1. The crossbow 1 may include a crossbow stock 3. The stock 3 may be generally longitudinal having first and second ends 4, 4' respectively. A crossbar 6 may be juxtaposed to the first end 4 of the stock 3 and fixedly connected thereto in a manner well known in the art. The crossbar 6 may include first and second ends 7, 7' that define an axis A that extends generally perpendicular to the longitudinal axis of the stock 3. The ends 7, 7' of the crossbar 6 may receive a bowstring 11 that extends between the ends 7, 7' of the crossbar 6 in a manner well known in the art. The crossbow 1 may be configured such that when the bowstring 11 is drawn back in a first direction B, the crossbar 6 may flex or bend storing potential energy in the crossbow 1. The bowstring 11 may be secured in place by a trigger mechanism 15 having a crossbow string latch, not shown, that selectively holds the bowstring 11 until it is desired to release or discharge the crossbow 1. When an associated operator draws the bowstring 11 back, the bowstring 11 is received by the latch, not shown, and is held in place until the trigger mechanism 15 is released. Once the bowstring 11 has been drawn back, an associated operator may place a projectile or bolt, not shown, onto the top portion of the stock 3 and fit a first end of the bolt over the bowstring 11. After such time, the trigger mechanism 15 may be engaged; releasing the force stored in the crossbow 1 and propelling the projectile forward in a second direction C.

Figure 2:
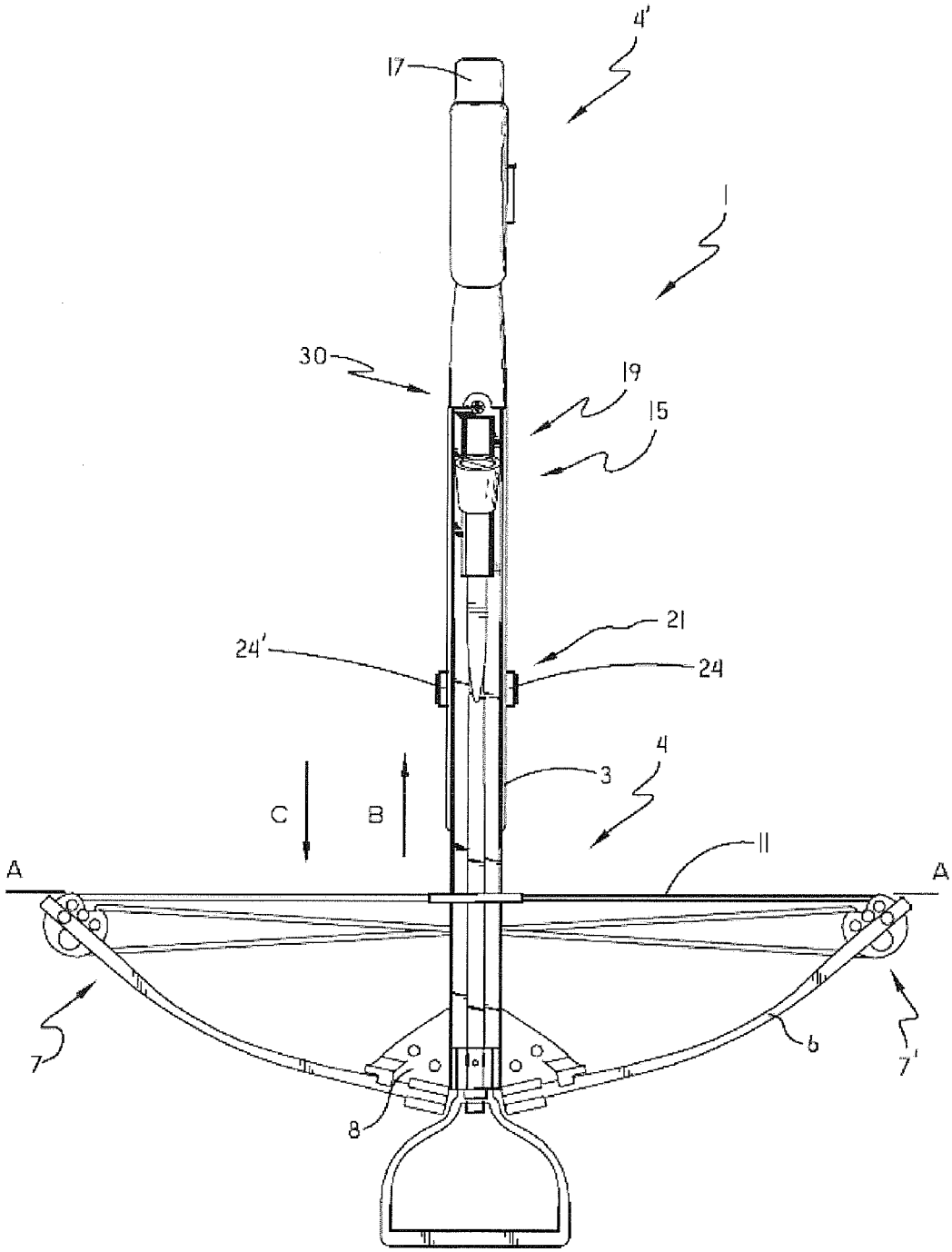
FIG. 2 shows a perspective top view of a crossbow having a stock safety device according to one embodiment of the invention.

With reference now to FIGS. 1 and 2, the crossbow 1 may include a crossbow butt 17. The butt 17 of the crossbow 1 may be juxtaposed to the associated operator's shoulder during discharge of the crossbow 1. A grip 19 may be operatively connected to the stock 3 wherein the trigger mechanism 15 is installed proximate to the grip 19; toward the second end 4' of the stock 3. This allows the associated operator to securely grasp the crossbow 1 with a first or non-firing hand during operation of the crossbow 1. The other hand of the associated operator may grasp the stock 3 toward the first end 4 thereof. This allows the operator to firmly hold the crossbow 1 during operation and discharge.

Figure 3:
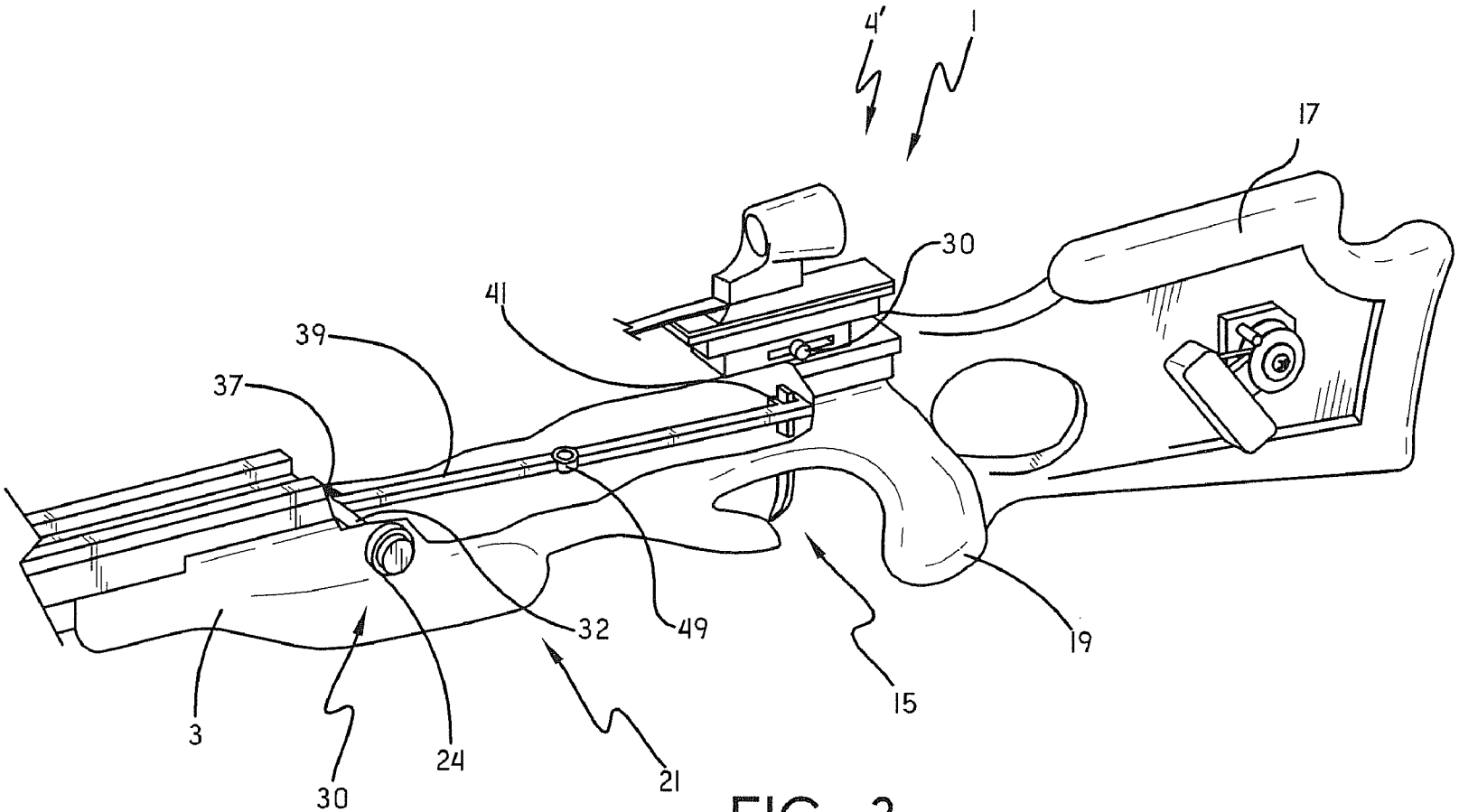
FIG. 3 shows a partial cutaway top view of a stock of a crossbow having a stock safety device according to one embodiment of the invention.

With reference again to FIGS. 1 and 2 and now to FIG. 3, the crossbow 1 may include a safety 30 for use in preventing the trigger mechanism 15 from engaging and thus from preventing discharge of the crossbow 1 when the bowstring 11 is drawn back. The safety 30 may be a mechanical safety interconnected to the trigger mechanism 15 such that when the safety 30 is engaged the trigger mechanism 11 cannot be operated, which prevents the crossbow 1 from being fired as previously discussed. In other words, when the safety 30 is engaged the trigger mechanism 15 cannot be pulled back or fired. The safety 30 may be configured in any manner chosen with sound engineering judgment. In one embodiment, the safety 30, when engaged, prevents the trigger mechanism 15 from firing by placing a mechanical block into the path of the trigger mechanism 15 thereby preventing the trigger mechanism 15 from moving and thereby preventing the crossbow 1 from firing.

With reference to FIGS. 1 through 3, the crossbow 1 may also include a safety mechanism 21 for preventing the crossbow from firing when the operator appendages are in the path of the traveling projectile. In one embodiment, the safety mechanism 21 may be a stock safety mechanism or stock safety 21. The stock safety 21 may include a first push button 24 mounted proximate to the position where the associated operator would grasp the stock 3 of the crossbow 1 during operation. In this manner, the crossbow 1 may only be fired when the first push button 24 is depressed. Since depressing the first push button 24 requires the use of the operator's thumb, and/or fingers on the opposing side of the stock, to apply pressure to the first push button 24, the crossbow 1 may only be fired when the thumb and/or finger is in contact with the first push button 24. In that the first push button 24 is disposed on the stock 3 and below the path of travel of the bowstring, the bowstring 11 cannot cause injury to the thumb and/or fingers thus providing a safety mechanism that prevents injury to the hand grasping the stock 3 of the crossbow 1. It is noted here that a firm grip on the stock 3 of the crossbow 1 is needed to properly fire the crossbow 1. Thus, the safety mechanism 21 would allow the operator to properly grasp the stock 3 while engaging the safety mechanism 21. The position of the stock safety 21 may reside on the either side of the stock 3 depending on the handedness of the associated operator. In other words, the stock safety 21 may be configured for either a left-handed or a right-handed operator. In an alternate embodiment, the stock safety 21 may include first 24 and second 24' push buttons, wherein the first and second push buttons 24, 24' reside one on each side of the stock 3 respectively. In this manner, the stock safety 21 may require the operator to depress the first push button 24 with the operator's thumb, for example and to depress the second push button 24' with the operator's fingers simultaneously to disengage the stock safety 21 for discharging the crossbow 1. It is noted that the stock safety 21 is normally engaged or biased in a default position to prevent firing of the crossbow 1. That is to say that when the crossbow 1 is set down after use, the safety mechanism 21 is biased to automatically engage thus preventing the trigger mechanism 15 from moving. It is also noted here that the safety mechanism 21 works in conjunction with the safety 30. Both safeties 30, 21 must be disengaged for the crossbow 1 to be fired.

Figure 4:
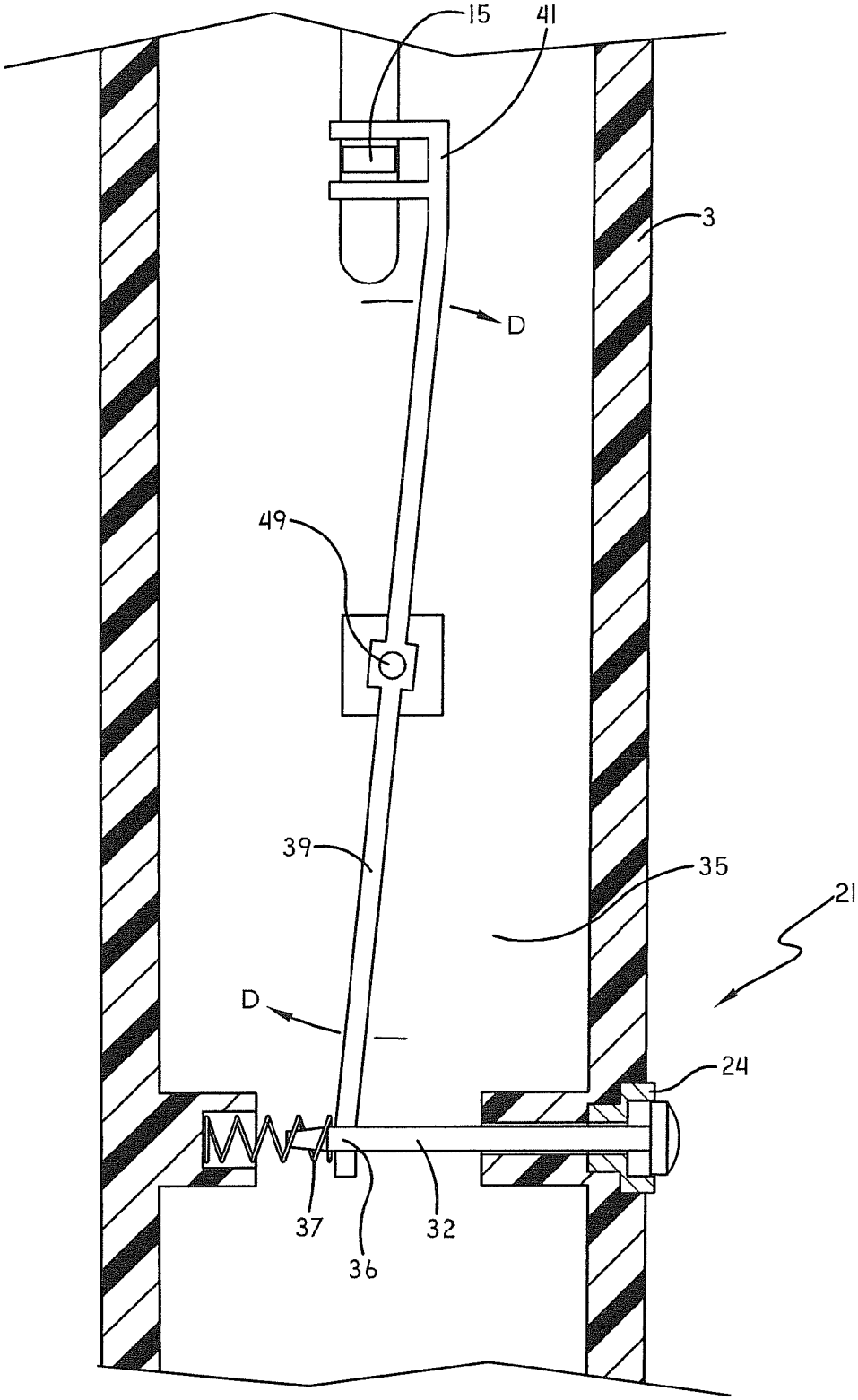
FIG. 4 shows a partial cutaway top view of the stock of a crossbow having a stock safety device according to one embodiment of the invention.

With continued reference to FIGS. 1 through 3 and now to FIG. 4, the first push button 24 may be disposed within the stock 3 of the crossbow 1 and extended to the exterior of the stock 3 for access by the operator. On the inside of the stock 3, the first push button 24 may be connected to a rod member 32. The first end 36 of the rod member 32 may contact biasing means 37, which may be a spring 37, for use in biasing the first push button 24 into a default position. Any type of biasing means may be chosen with sound engineering judgment as is appropriate for use with the present invention. In this manner, when the operator releases the first push button 24, the rod member 32 and the first push button 24 return to a default safety state as biased by the spring 37. A rigid linkage member 39 may also be included that is fixedly connected to the rod member 32 at the proximate end of the linkage member 39. The distal end of the rigid linkage member 39 may include a bifurcated portion 41 that may engage the trigger mechanism 15. The bifurcated portion 41 may be integrally formed with linkage member 39. However, any configuration of linkage member 39 and bifurcated portion 41 may be chosen with sound engineering judgment. Accordingly, the entire linkage member 39 may be pivotally connected with respect to the body of the stock 3, thereby allowing the linkage member 39 and the bifurcated portion 41 to pivot into and out of engagement with the trigger mechanism 15, as shown in FIG. 4. It is noted here that the linkage member 39 may pivot about a fixed point 49 within the stock 3 but may not move otherwise. Any manner of allowing the linkage member 39 to pivot without otherwise translating may be chosen with sound engineering judgment. When the operator depresses the first push button 24, thus overcoming the force of the biasing means 37, the rod member 32 may pivot the linkage member 39 and more specifically the bifurcated end 41 of the linkage member 39 out of engagement with the trigger mechanism 15. Therefore, the stock safety 21 is normally engaged, and must be intentionally disengaged in order to actuate the trigger mechanism 15 thus firing the crossbow 1. It should be emphasized that the present embodiment discusses a mechanical safety mechanism 21 including a mechanical linkage member 39. However, it is noted that any assembly and/or configuration of linkage members, including but not limited to mechanical, electrical, electromagnetic, and the like may be chosen with sound engineering judgment.

Figure 5:
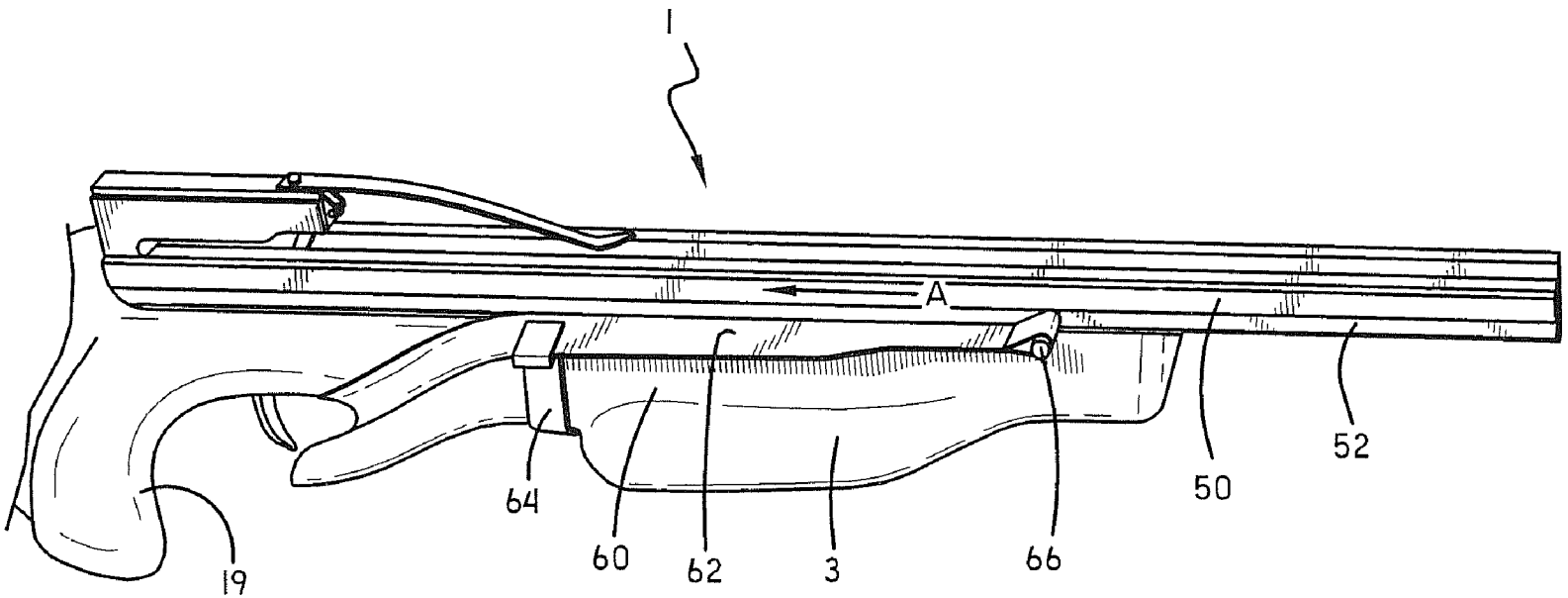
FIG. 5 shows a partial side view of a crossbow showing the crossbow grip guard retro-fitted to an existing crossbow according to one embodiment of the invention.
Figure 6:
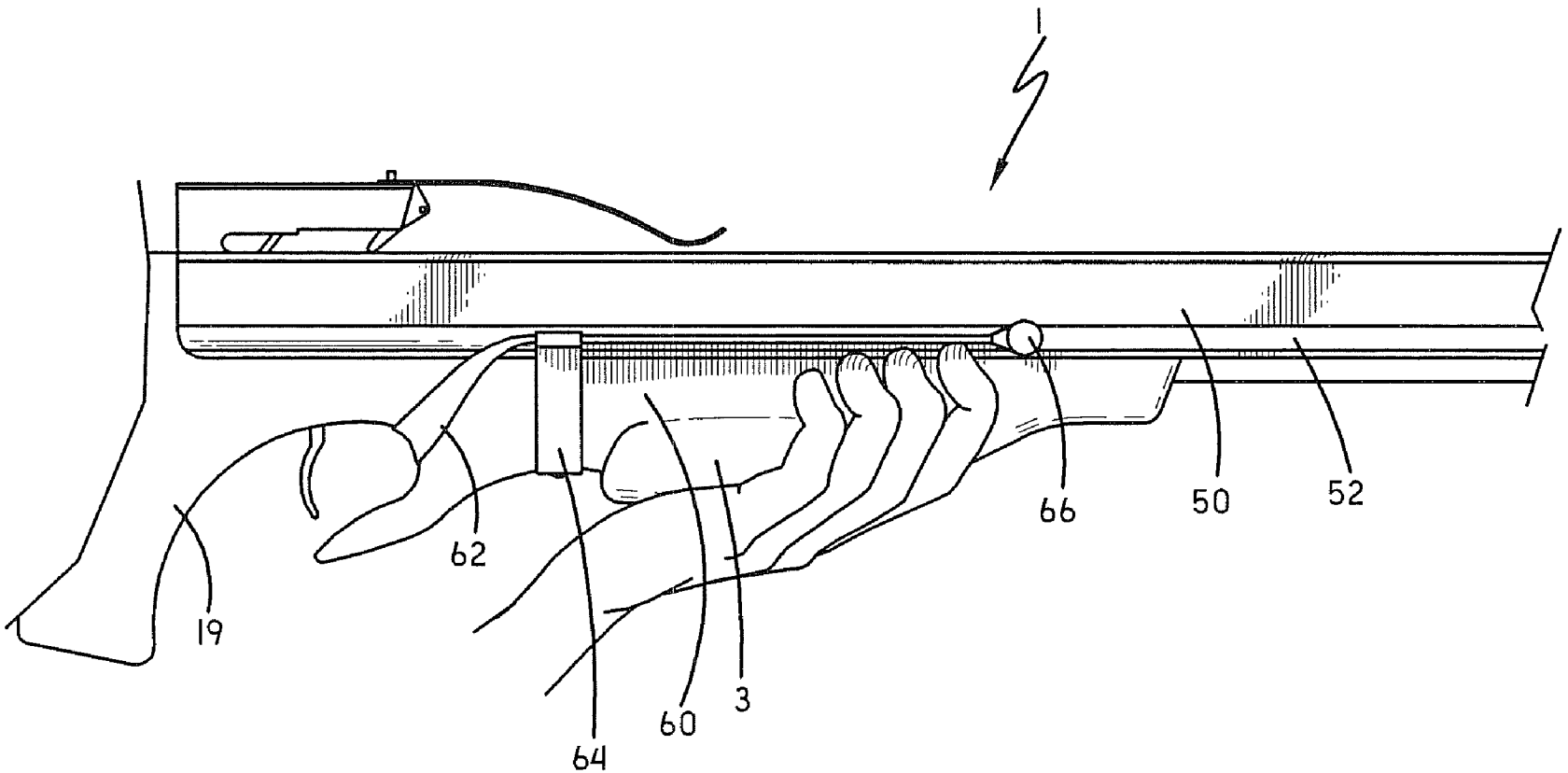
FIG. 6 shows a partial side view of a crossbow having the crossbow grip guard; according to one embodiment of the invention.

With reference to FIGS. 1, 5 and 6, a grip guard 60 is shown. The grip guard 60 has an outwardly extending member 62. The outwardly extending member 62 extends outwardly perpendicular to the stock 3 and a barrel 50 of the crossbow 1. The outwardly extending member 62 need not be exactly perpendicular to a longitudinal axis of the barrel 50 or stock 3. The grip guard 60 may also have a locking member 64 that secures the outwardly extending member 62 to the stock 3. The need for the locking member 64 would be where the grip guard 60 is retro-fitted to an existing crossbow 1. In that case, there is also an axis 66 that slides within an opening 52 of the barrel 50. The outwardly extending member 62 may be secured to the axis 66. The axis 66 may be secured in place by the force of the outwardly extending member 62 pulling in a direction toward the butt 17 of the crossbow 1. This force is shown in FIG. 5 in the direction of arrow A. Locking member 64 engages outwardly extending member 62 to ensure that it in fact stays outward (i.e., perpendicular). The outwardly extending member 62 is typically made of sheet metal, however, it can be made of any material which accomplishes the objective of extending the outwardly extending member 62. The locking member 64 may travel across to the other side of the crossbow 1, which may look substantially identical to the side shown in FIGS. 5, 6. The outwardly extending member 62 may extend around, under and through the grip 19 as shown within FIGS. 5, 6. In one embodiment, the outwardly extending member 62 may comprise a solid piece of material, such as rubber, however, any material accomplishing the intended function of the outwardly extending member 62 is within the scope of this invention, including multiple, separate pieces.

The objective of the grip guard 60 is to keep the operator's fingers below the bolt path. The grip guard 60 provides an obstacle that helps prevent an operator's fingers from extending over the grip guard 60 and onto the path of a bolt. The grip guard 60 may also serve as a tactical reminder of the proper hand position for gripping the crossbow 1. Therefore, any means that accomplishes that end result is within the scope of the grip guard 60.

Figure 7:
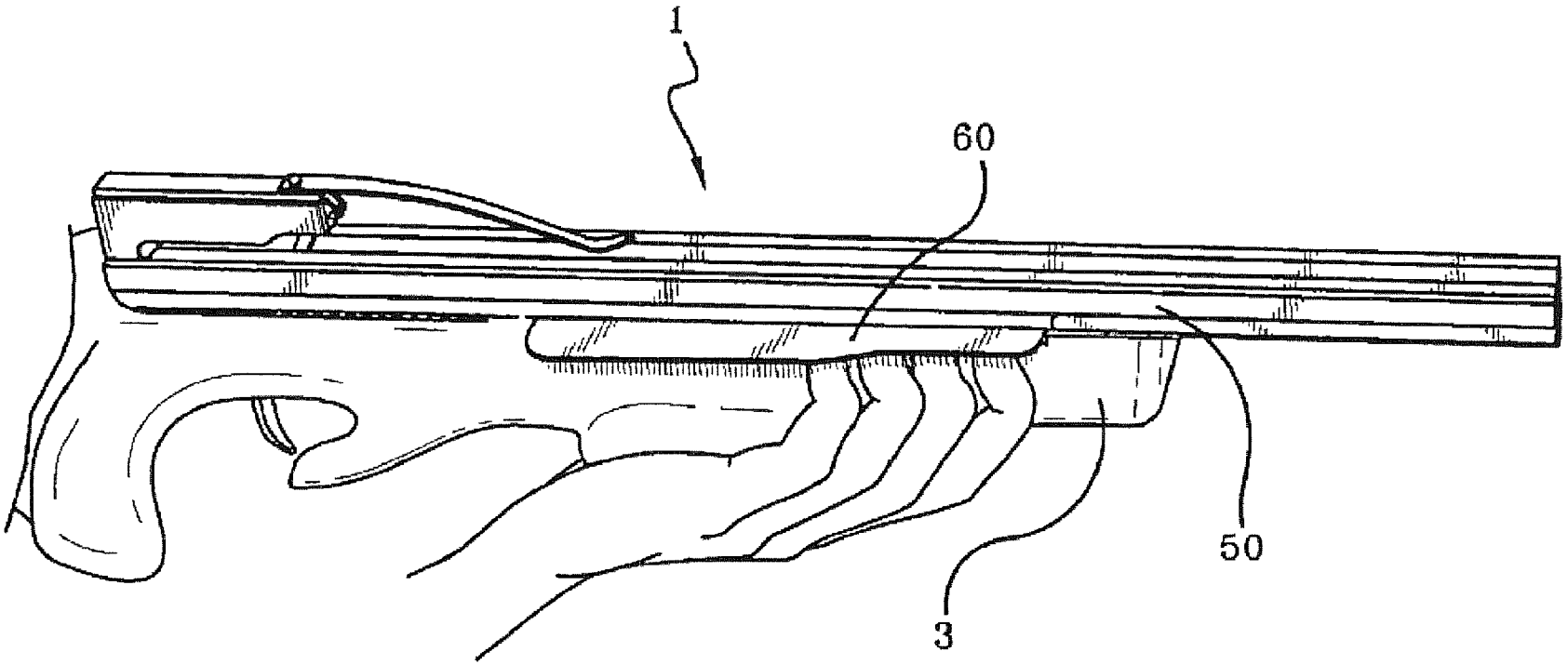
FIG. 7 shows a partial side view of a crossbow where the crossbow grip guard is molded into the stock according to one embodiment of the invention.
Figure 7A:
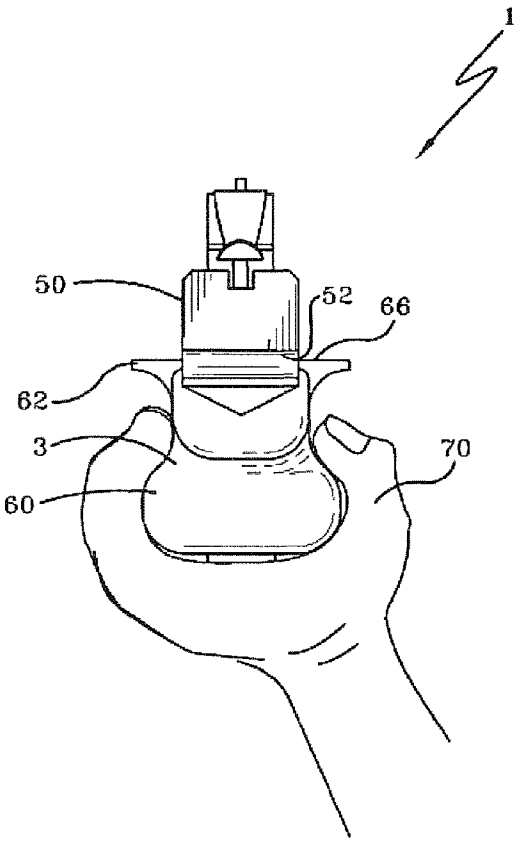
FIG. 7A shows an end view of a stock of a crossbow having the crossbow grip guard molded into the stock according to one embodiment of the invention.

With reference now to FIG. 7, in one embodiment, the grip guard 60 may be molded within the crossbow 1. The molded grip guard 60 may be molded within the stock 3 and extend outwardly of the barrel 50. With respect to FIG. 7A, the grip guard 60 is shown from an end view. The outwardly extending member 62 is molded within the stock 3. A normal user's hand 70 is shown in FIG. 7A. Outwardly extending member 62 extends outwardly from the stock 3 such that the user's hand 70 would not extend above outwardly extending member 62. While it is possible for larger hand 70 to be able to extend beyond extending member 62, it would be difficult and awkward for such occurrence.

Figure 8:
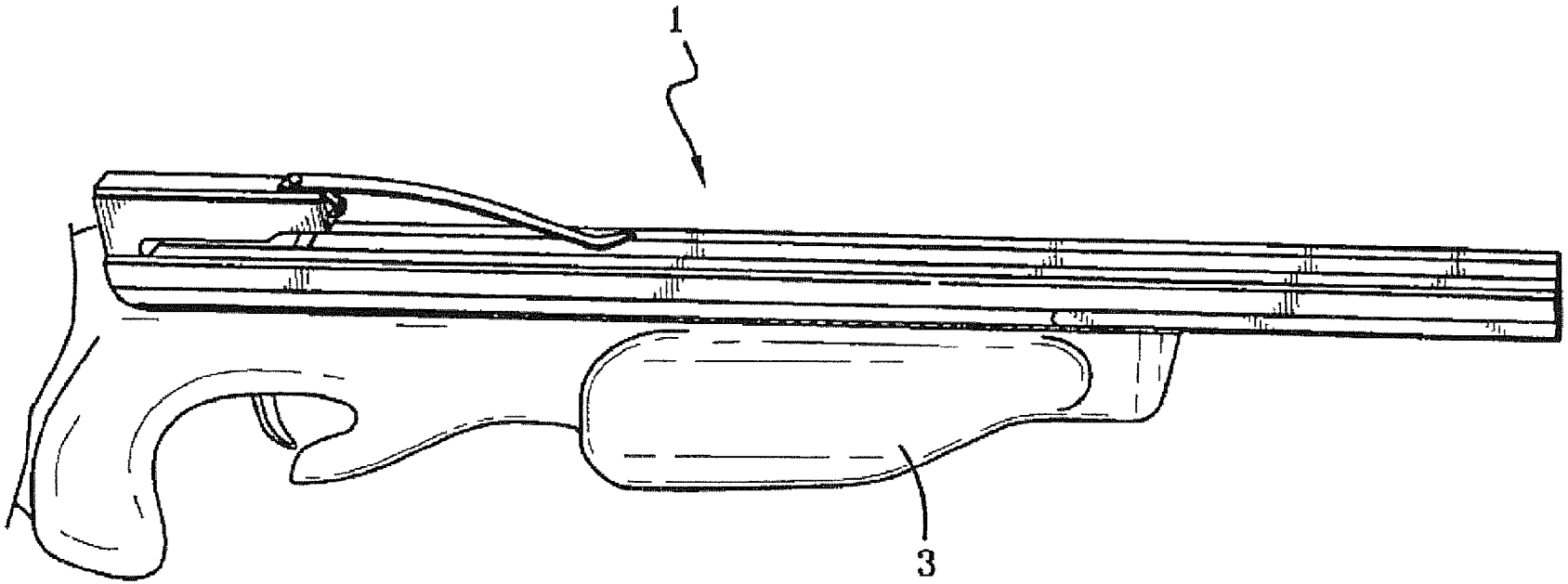
FIG. 8 is a partial side view of a crossbow having an enlarged stock such that a normal user's fingers are unable to reach into the bolt path according to one embodiment of the invention.
Figure 8A:
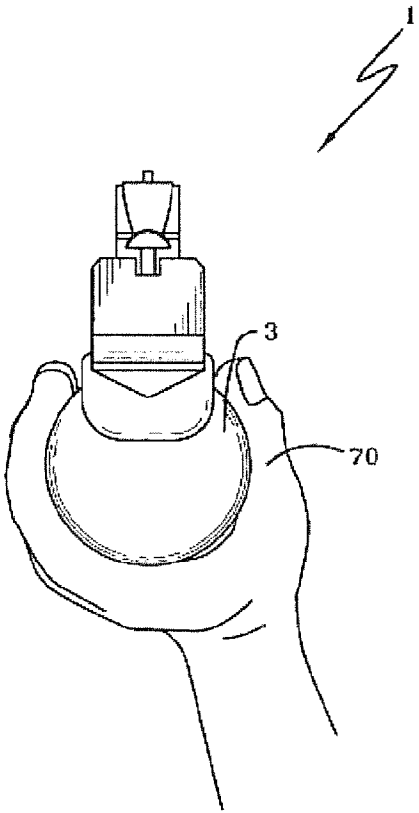
FIG. 8A is an end view of a stock of a crossbow having an enlarged crossbow stock according to one embodiment of the invention.

Turning now to FIGS. 8 and 8A, an elongated or oversized stock 3 such that an operator's hand (i.e., fingers) would either be unable to reach the bolt path or otherwise make it uncomfortable is shown. FIG. 8 shows an enlarged stock 3 without an outwardly extending grip guard. The enlarged stock 3 is enlarged enough such that a normal-size hand/finger would be unable to reach the bolt path. An end view shown in FIG. 8*a* shows the enlarged stock 3 being gripped by a normal-sized hand. Obviously, a user who has abnormally-sized large hands and fingers may be able to circumvent the grip guard of the enlarged stock 3; however, not without the deterrence of the enlarged stock 3 or being very uncomfortable.

Figure 9:
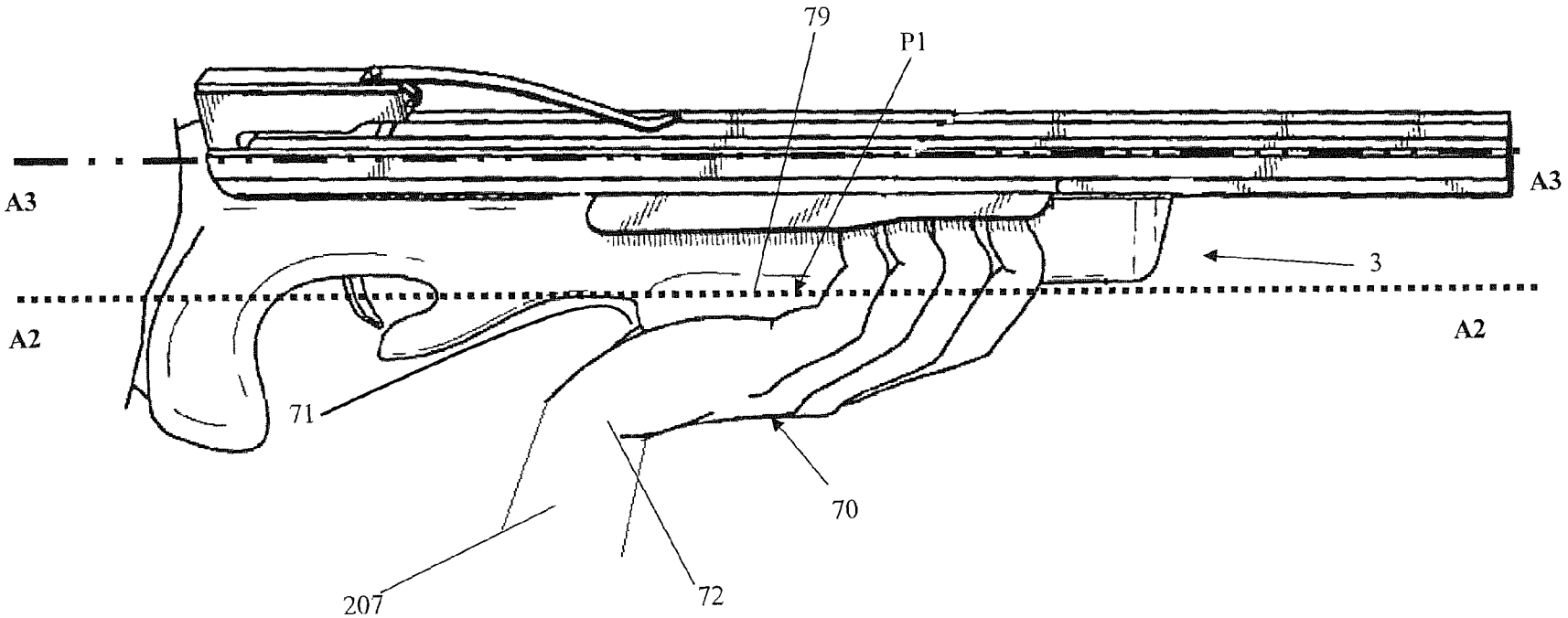
FIG. 9 shows a perspective view of a user holding a crossbow comprising an angled grip wherein the angled grip is in a conventional-grip position according to one embodiment of the invention.
Figure 10:
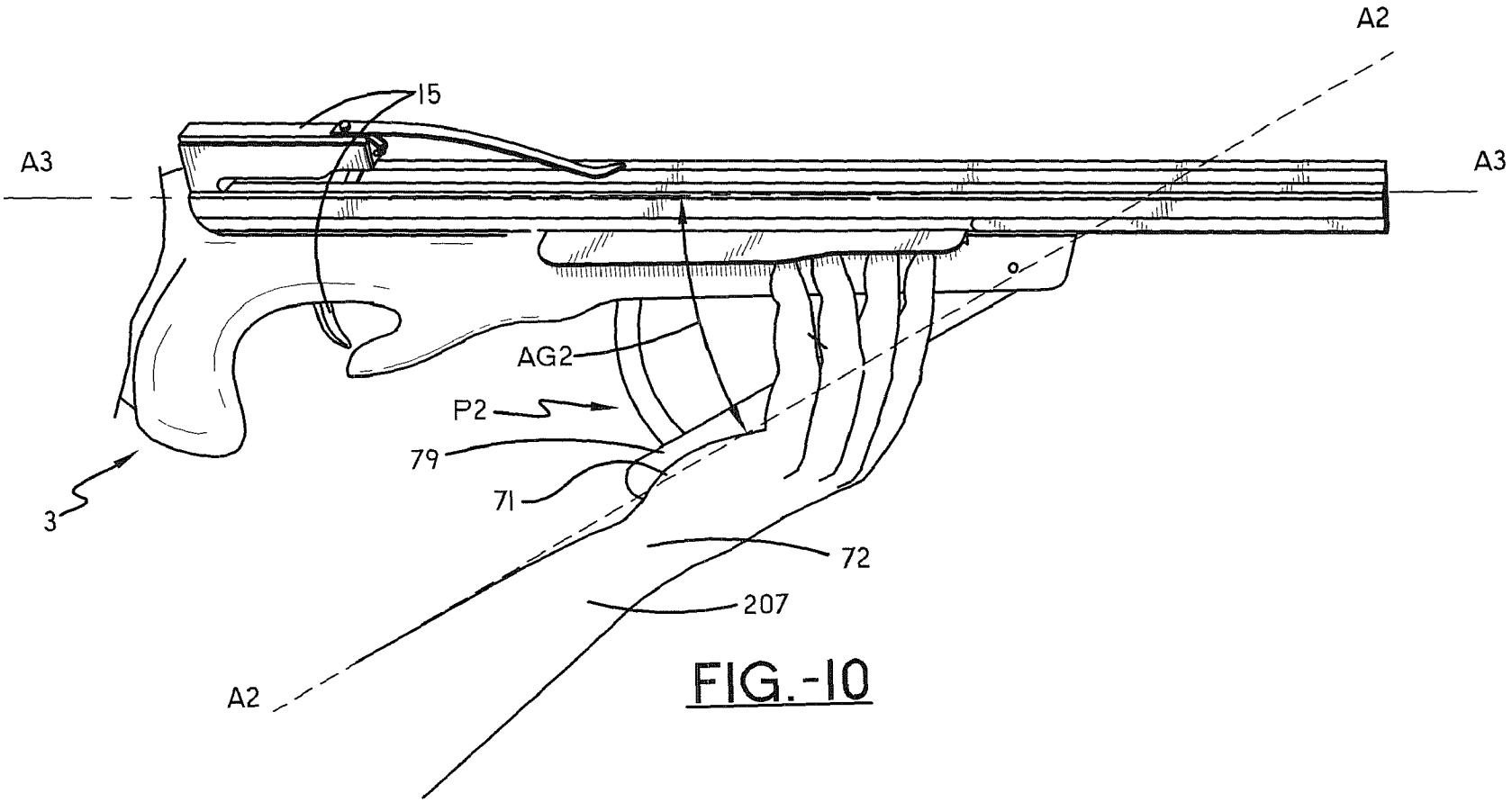
FIG. 10 shows a perspective side view of a user holding a crossbow device comprising an angled grip wherein the angled grip is in an angled-grip position according to one embodiment of the invention.

With reference now to FIGS. 1 and 9-10, in one embodiment, the grip 19 may comprise an angled grip 79. The angled grip 79 may allow the user to hold the crossbow 1 in a more comfortable and natural position when aiming and discharging the crossbow 1. Conventional grips are positioned substantially parallel to the longitudinal axis A3 of the stock 3 thereby requiring the user's wrist 72 and palm 71 of the user's non-firing hand to be bent over at an angle with respect to the user's forearm 207 when aiming or discharging the crossbow 1. Stated differently, the palm 71 forms a plane that is approximately parallel to the longitudinal axis A3 of the stock 3. The angled grip 79 may allow the user's wrist 72 and palm 71 to be substantially aligned with the user's forearm 207 when aiming or discharging the crossbow 1. The angled grip 79 may comprise a grip assembly that is operatively connected, and positioned adjacent, to the lower portion of the stock 3. The angled grip 79 may be positioned between the trigger mechanism 15 and a riser block assembly 8, shown in FIG. 1, such that the user grasps the angled grip 79 with the non-firing hand 70 when aiming and discharging the crossbow 1. The angled grip 79 may extend generally downward from the stock 3. In one embodiment, the angled grip 79 may extend substantially directly beneath the stock 3. In another embodiment, the angled grip 79 may extend generally downward such that the angled grip 79 extends at an angle with respect to the longitudinal axis A3 of the stock 3. The angled grip 79 may be attached to the stock 3 such that the angle at which the angled grip 79 extends generally downward and/or the position to which the angled grip 79 extends generally downward to is substantially fixed relative to the position at which the angled grip 79 is attached to the stock 3. In another embodiment, the angled grip 79 may comprise a means for allowing the angle at which the angled grip 79 extends generally downward and/or the position to which the angled grip 79 extends generally downward to may be selectively varied by the associated user. Although the angled grip 79 is described in conjunction with a crossbow, the angled grip 79 may be utilized with any type of weapon chosen with sound judgment by a person of ordinary skill in the art.

Figure 15:
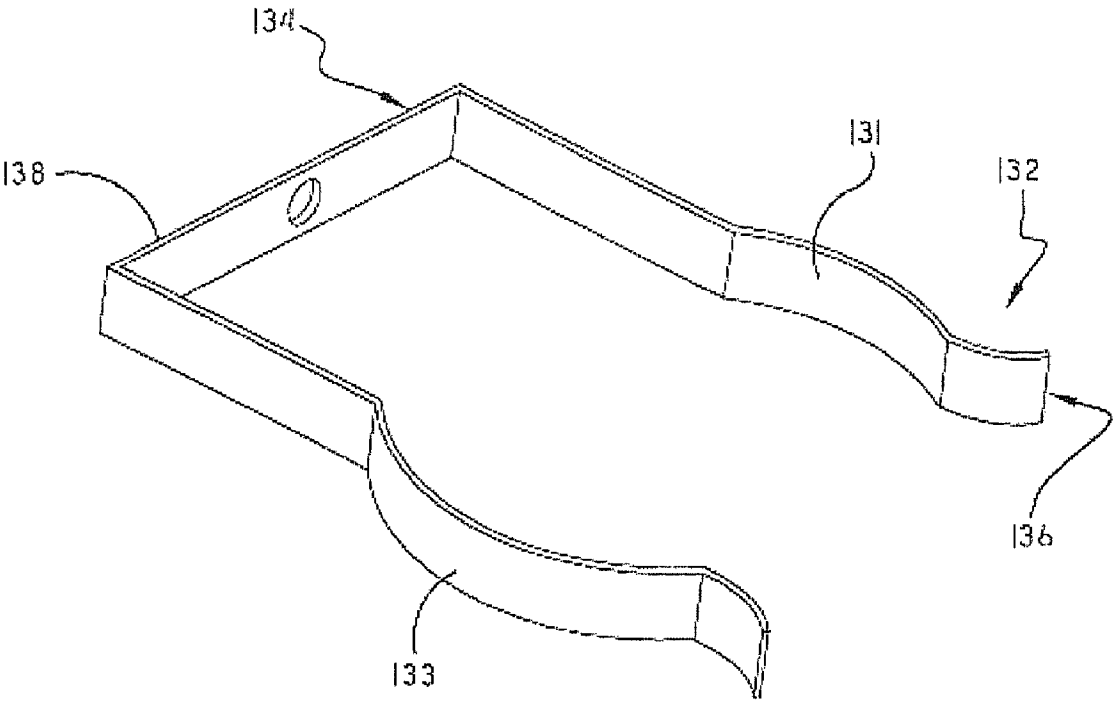
FIG. 15 shows a perspective view of a clip that may be used to secure an angled grip in a conventional-grip position according to one embodiment of the invention.

With continuing reference now to FIGS. 1, 9, and 10, the angled grip 79 may be coupled to the stock 3 such that the user may selectively adjust the orientation or position of the angled grip 79 with respect to the stock 3. In one embodiment, the angled grip 79 may be selectively adjustable between a first or conventional-grip position P1 and a second or angled-grip position P2. The conventional-grip position P1 may comprise a position wherein the angled grip 79 extends in a direction that is substantially parallel to the longitudinal axis A3 of the stock 3, as shown in FIG. 9. The angled-grip position P2 may comprise a position that allows the user's wrist 72 and palm 71 to be substantially aligned with the user's forearm 207 when aiming or discharging the crossbow 1. In one embodiment, the angled-grip position P2 may comprise a position wherein the angled grip 79 downwardly extends to a position that is substantially directly beneath the stock 3, as shown in FIG. 10. In another embodiment, the angled-grip position P2 may comprise a position wherein the angled grip 79 extend downwardly such that the body of the angled grip 79 extends at an angle with respect to the longitudinal axis A3 of the stock 3. The angled grip 79 may comprise means for retaining the angled grip 79 in the orientation or position selected by the user. For example, the angled grip 79 may be retained in the conventional-grip position P1 by a spring steel pole clip 110, shown in FIG. 15, that attaches to a rod member, not shown, positioned in the interior portion of the angled grip 79.

With reference now to FIGS. 1, 9, 10, and 11, in one embodiment, the angled grip 79 may be pivotally attached to the stock 3. The pivotal attachment may be accomplished with a ball joint mount 123 having a first end 131 operatively connected to the stock 3 and a second end 133 operatively connected to the angled grip 79. In one specific embodiment, the first end 131 may comprise a shaft 134 that is fixedly received in the stock 3 and the second end 133 may comprise a spherical portion 132 that is rotatably received in a socket 130 formed at the end of the angled grip 79. This arrangement permits the angled grip 79 to be easily moved by rotation relative to the stock 3. In one embodiment, the ball joint mount 123 may allow for substantially 360 degrees of rotation and substantially 180 degrees of pivotal movement of the angled grip 79 relative to the stock 3. In a more specific embodiment, the shaft 134 of the ball joint mount 123 may have threads that are received in the threads formed in the stock 3 that are exposed when a sling swivel stud 102 attached to the stock 3 is removed.

Figure 11:
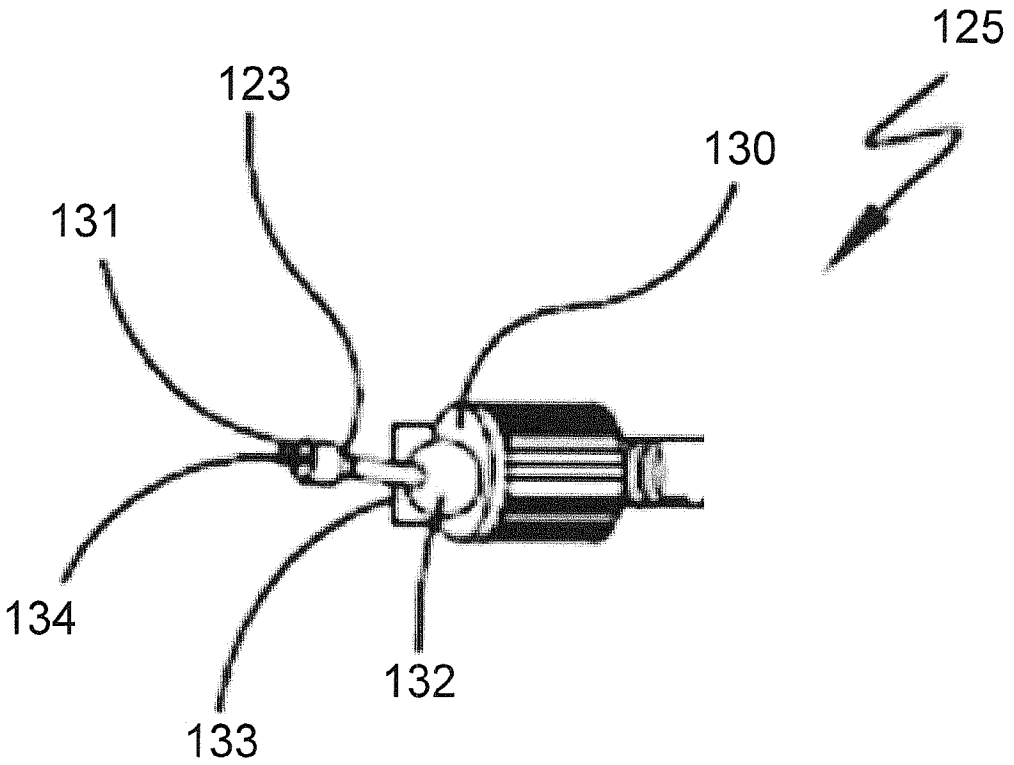
FIG. 11 shows an enlarged view of a ball joint mount for coupling an angled grip to a stock of a crossbow according to one embodiment of the invention.
Figure 12:
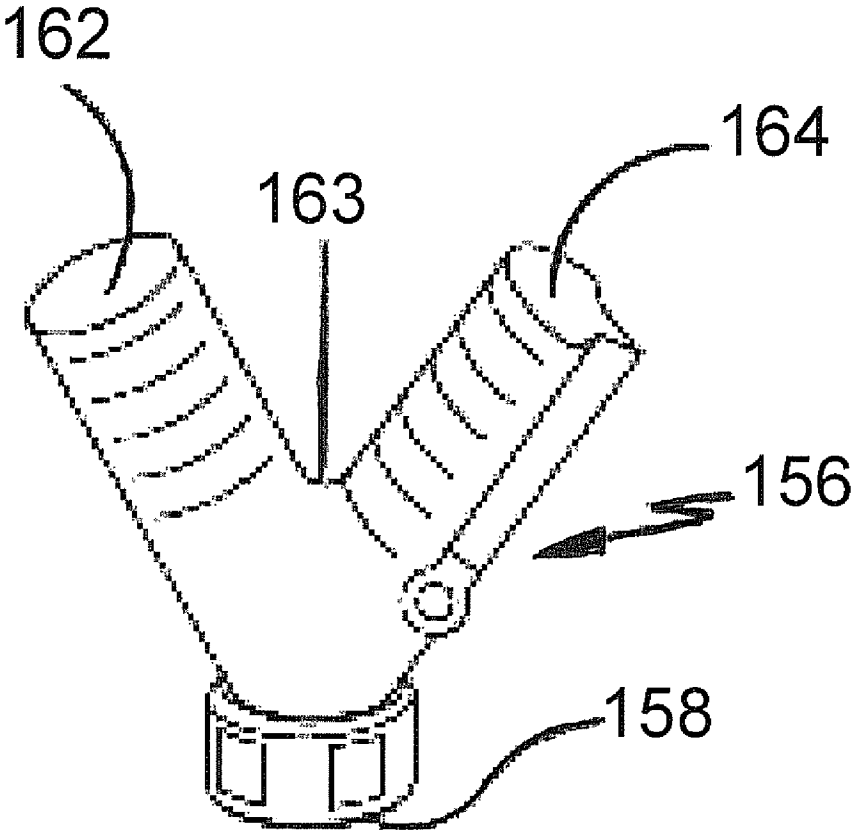
FIG. 12 shows a perspective view of a V-shaped support member that may be used to couple an angled grip to a stock of a crossbow according to one embodiment of the invention.
Figure 13:
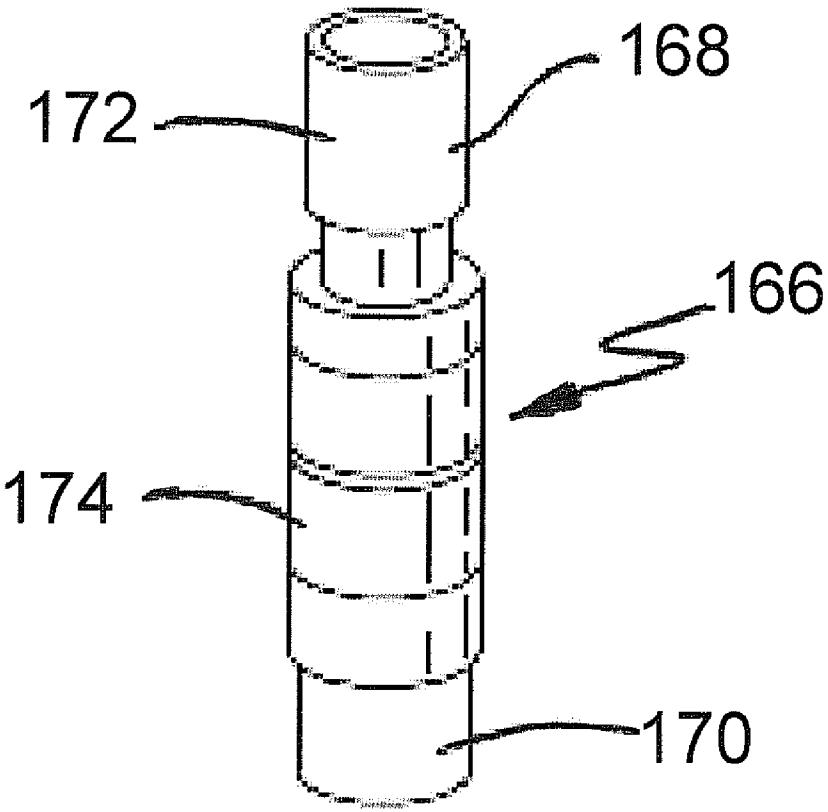
FIG. 13 shows a perspective view of a quick attach member that may be used to provide a method for selectively attaching and detaching an angled grip from a stock of a crossbow according to one embodiment of the invention.
Figure 14:
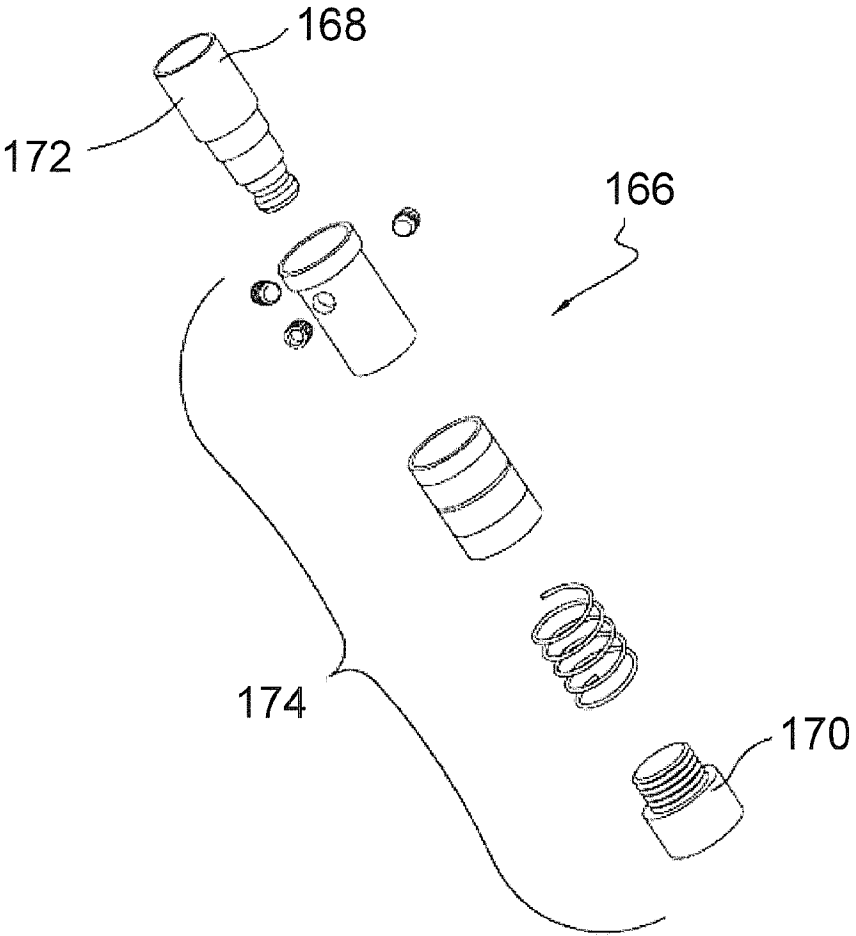
FIG. 14 shows an assembly view of the quick attach member shown in FIG. 13.

With reference now to FIGS. 9-14, in another embodiment shown in FIG. 12, a V-shaped support member 156 is attached to the end of the angled grip 79. The support member 156 may have a pair of arms 162, 164 defining a support surface 163 that supports the crossbow 1. The support member 156 may also have a cylindrical base 158 that attaches to the angled grip 79 with threads that are received with corresponding threads on the end of the angled grip 79. In one embodiment, the support member 156 is interchangeable with the ball joint mount 123 providing flexibility. In still another embodiment shown in FIGS. 13 and 14, a quick attach member 166 may be used to provide a very quick method of attaching and detaching the angled grip 79. In one embodiment the quick attach member 166 can be installed between the ball joint mount 123 and the end of the angled grip 79. The particular design of the quick attach member 166 can be any chosen with sound judgment by a person of ordinary skill in the art. For the embodiment shown, however, the quick attach member 166 has a first end 168 that attaches to the second end 133 of the ball joint mount 123 and a second end 170 which attaches to the end of the angled grip 79. The quick attach member 166 may comprise a plug 172 and a socket 174. FIG. 14 shows an assembly drawing of how the plug 172 and socket 174 may be designed. As the operation of a quick attach member 166 is known in the art a detailed description will not be provided here.

Figure 16:
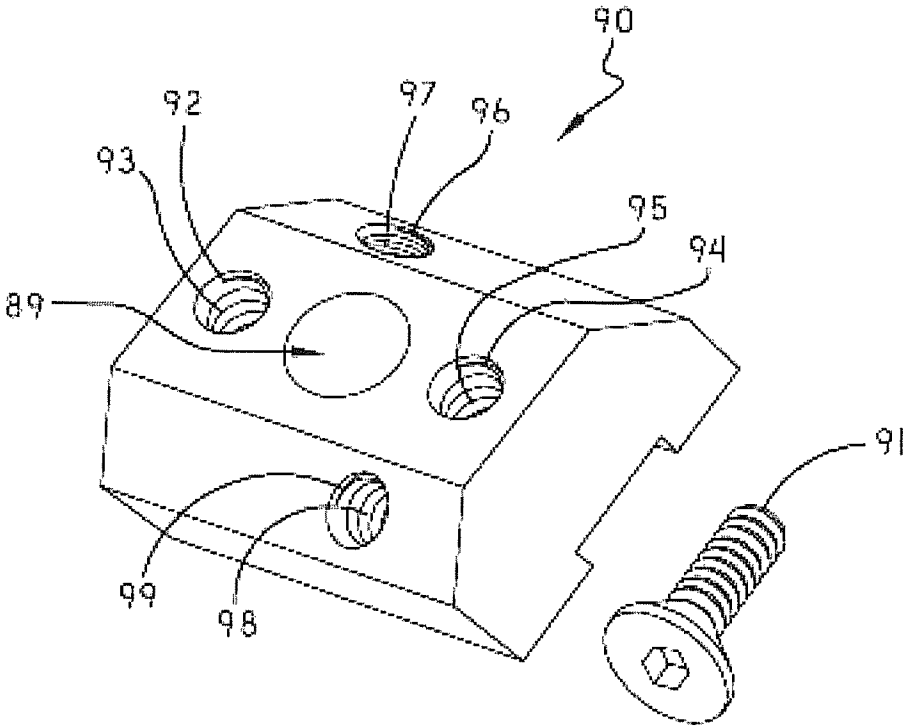
FIG. 16 shows a perspective view of a mounting bracket that may be used to provide at least two locations for attaching an angled grip to a crossbow according to one embodiment of the invention.

With reference now to FIGS. 1, 9-11, and 16, in another embodiment, a mounting bracket 190 may be attached to the stock 3. The mounting bracket 190 may be attached in any known manner. In one embodiment, the mounting bracket 190 is attached to the stock 3 by use of a screw 191 received in opening 189 having threads that are received in the threads formed in the stock 3 that are exposed when a sling swivel stud 102 is removed. In one embodiment, the mounting bracket 190 has a first connection location 192 that connects to some portion of the angled grip 79 or a device connected to the angled grip 79. The first connection location 192 may, for example, have an opening 193 that receives the shaft 134 of the ball joint mount 123. In another embodiment, the mounting bracket 190 has a second connection location 194 also for use in connecting the angled grip 79 to the stock 3. The second connection location 194 may have an opening 195 of the same size as the opening 193. In this case, the user has two locations to choose from as to where to connect the angled grip 79. Additional connection locations could also be provided to supply additional options for the user. In another embodiment, the second opening 195 may have a substantially different size (depth and/or diameter and/or shape, etc.) from the first opening 193. Different diameters are shown in FIG. 16. In this case, the user can use one of two different sized shafts 134; one for the first opening 193, and another for the second opening 195.

With continuing reference to FIGS. 1, 9-11, and 16, in another embodiment, the mounting bracket 190 may have a third connection location 196 with an opening 197 adapted to receive the sling swivel stud 102. This is especially useful if the sling swivel stud 102 was removed in order to attach the mounting bracket 190 to the stock 3. In still another embodiment, the mounting bracket 190 may have a fourth connection location 198 with an opening 199 also adapted to receive the sling swivel stud 102. In this case, the user has two locations to choose from as to where to connect the sling swivel stud 102. In another embodiment, the third and fourth connection locations 196, 198 may be located on opposite sides of the mounting bracket 190 at an angle, as shown. In this case, the sling swivel stud 102 would extend at least partially to one side of the stock 3 if it is positioned at the third connection location 196 and at least partially to the opposite side of the stock 3 if it is positioned at the fourth connection location 198.

With reference now to FIGS. 9-11, in one embodiment, the angled grip 79 may comprise a moldable composition, wherein the angled grip 79 can be molded to substantially conform to the shape of the user's non-firing hand 202. The angled grip 79 may comprise any resilient, moldable, settable material in which impressions of the user's hand may be made when the angled grip 79 is heated to a predetermined temperature range and subjected to pressure resulting from the user gripping the angled grip 79 and preserved when the angled grip 79 is cooled to a temperature below that range chosen with sound judgment by a person of ordinary skill in the art. In one embodiment, the moldable composition may surround a rigid core, not shown, that has a softening temperature above the predetermined temperature range of the moldable composition. The moldable composition may be applied substantially completely over the rigid core, not shown. The rigid core, not shown, may provide structural support throughout the length of the angled grip 79 during the time the angled grip 79 is heated to a temperature within the predetermined temperature range as well as after the moldable composition has been cooled to a temperature below the predetermined temperature range. In one embodiment of the invention, the angled grip 79 may comprise an ultra-high molecular weight low temperature thermoplastic that allows the angled grip 79 to be shaped by the user at relatively low temperatures and pressures, for example at about 100° F. to about 120° F. The rigid core, not shown, may comprise a thermoplastic material having a softening temperature above 160° F.

The embodiments have been described, hereinabove. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

Having thus described the invention, it is now claimed:

1. A crossbow comprising:

a stock having a first stock end and a second stock end;

a crossbar fixedly connected to the first stock end, wherein the crossbar comprises a first crossbar end and a second crossbar end that define a first axis that extends substantially perpendicular to a longitudinal axis of the stock;

a bowstring operatively connected between the first crossbar end and the second crossbar end;

a trigger mechanism that allows for the selective retention and release of the bowstring;

and, an angled grip operatively connected to the stock, wherein the angled grip allows a wrist, a palm, and a forearm of an associated user to be substantially aligned when aiming or discharging the crossbow, wherein the angled grip is selectively adjustable between a first position and a second position, wherein the second position comprises an angled-grip position that allows the wrist, the palm, and the forearm of the associated user to be substantially aligned when aiming or discharging the crossbow.

2. The crossbow of claim 1, wherein the angled grip is pivotally attached to the crossbow.

3. The crossbow of claim 2, wherein the angled grip further comprises:

a ball joint mount having a first end operatively connected to the stock and a second end operatively connected to the angled grip, wherein the ball joint mount comprises a shaft fixedly received in the stock and a spherical portion rotatably received in a socket formed in an end of the angled grip.

4. The crossbow of claim 3, wherein the crossbow further comprises:

a quick attach member for selectively attaching the angled grip to the ball joint mount.

5. The crossbow of claim 3, wherein the shaft of the ball joint mount comprises a first plurality of threads that are received by a second plurality of threads formed in the stock.

6. The crossbow of claim 5, wherein the second plurality of threads are exposed by the removal of a sling swivel stud that is attached to the stock.

7. A crossbow comprising:

a stock having a first stock end and a second stock end;

a crossbar fixedly connected to the first stock end, wherein the crossbar comprises a first crossbar end and a second crossbar end that define a first axis that extends substantially perpendicular to a longitudinal axis of the stock;

a bowstring operatively connected between the first crossbar end and the second crossbar end;

a trigger mechanism that allows for the selective retention and release of the bowstring; and, an angled grip operatively connected to the stock, wherein the angled grip allows a wrist, a palm, and a forearm of an associated user to be substantially aligned when aiming or discharging the crossbow;

a support member attached to an end of the angled grip and having substantially a v-shape, wherein the support member comprises:

a first arm and a second arm that define a support surface for supporting the crossbow; and, a cylindrical base having a first plurality of threads that are received by a second plurality of threads on the end of the angled grip.

8. A crossbow comprising:

a stock having a first stock end and a second stock end;

a crossbar fixedly connected to the first stock end, wherein the crossbar comprises a first crossbar end and a second crossbar end that define a first axis that extends substantially perpendicular to a longitudinal axis of the stock;

a bowstring operatively connected between the first crossbar end and the second crossbar end;

a trigger mechanism that allows for the selective retention and release of the bowstring; and, an angled grip operatively connected to the stock, wherein the angled grip allows a wrist, a palm, and a forearm of an associated user to be substantially aligned when aiming or discharging the crossbow; and, a mounting bracket attached to the stock, wherein the mounting bracket comprises a first connection location that operatively connects the angled grip to the crossbow.

9. The crossbow of claim 8, wherein the crossbow further comprises:

a ball joint mount comprising a shaft and a spherical portion; and the first connection location comprises an opening, wherein the opening receives a first end of the shaft and the spherical portion is rotatably received in a socket formed in an end of the angled grip.

10. The crossbow of claim 8, wherein the mounting bracket further comprises:

a second connection location for use in operatively connecting the angled grip to the crossbow.

11. The crossbow of claim 10, wherein the mounting bracket further comprises:

a third connection location having an opening adapted to receive a sling swivel stud.

12. A crossbow comprising:

a stock having a first stock end and a second stock end;

a crossbar fixedly connected to the first stock end, wherein the crossbar comprises a first crossbar end and a second crossbar end that define a first axis that extends substantially perpendicular to a longitudinal axis of the stock;

a bowstring operatively connected between the first crossbar end and the second crossbar end;

a trigger mechanism that allows for the selective retention and release of the bowstring; and, an angled grip operatively connected to the stock, wherein the angled grip allows a wrist, a palm, and a forearm of an associated user to be substantially aligned when aiming or discharging the crossbow a moldable composition, wherein the moldable composition allows the angled grip to be molded to substantially conform to a shape of a hand of the associated user when heated to a first temperature within a predetermined temperature range and the moldable composition retains the shape of the hand when cooled to a second temperature that is below the predetermined temperature range.

13. The crossbow of claim 12, wherein the angled grip further comprises:

a rigid core, wherein the moldable composition is applied substantially completely over the rigid core and the rigid core provides structural support substantially throughout the length of the angled grip during the time the moldable composition is heated to the first temperature and after the moldable composition is cooled to the second temperature.

14. An angled grip comprising:

a ball joint mount for operatively connecting the angled grip to a weapon, wherein the ball joint mount comprises:

a shaft that can be fixedly received in a stock of the weapon;

a spherical portion rotatably received in a socket formed in an end of the angled grip; and a mounting bracket, wherein the mounting bracket can be attached to the stock of the weapon and comprises a first connection location having a first opening that can receive the shaft of the ball joint mount for operatively connecting the angled grip to the weapon, wherein the angled grip allows a wrist, a palm, and a forearm of an associated user to be substantially aligned when aiming or discharging the weapon.

15. A method comprising the steps of:

(a) providing a crossbow having a stock having a first stock end and a second stock end; a crossbar fixedly connected to the first stock end, wherein the crossbar comprises a first crossbar end and a second crossbar end that define a first axis that extends substantially perpendicular to a longitudinal axis of the stock; a bowstring operatively connected between the first crossbar end and the second crossbar end; a trigger mechanism that allows for the selective retention and release of the bowstring; and, a grip for allowing an associated user to securely grasp the crossbow during operation of the crossbow;

(b) adjusting the grip from a first position to a second position, wherein the second position allows a wrist, a palm, and a forearm of the associated user to be substantially aligned when aiming or discharging the crossbow;

(c) aiming the crossbow; and, (d) firing the crossbow.

16. The method of claim 15, wherein step (b) further comprises the step of:

operatively connecting the grip to the crossbow, wherein the grip comprises a ball joint mount having a shaft that can be fixedly received in the stock of the crossbow and a spherical portion rotatably received in a socket formed in an end of the grip.

17. The method of claim 15, wherein step (b) further comprises the steps of:

removing a sling swivel stud attached to the stock of the crossbow to reveal a first plurality of threads;

operatively connecting the grip to the crossbow, wherein the grip comprises a ball joint mount having a shaft comprising a second plurality of threads that can be received in the first plurality of threads and a spherical portion rotatably received in a socket formed in an end of the grip.

18. The method of claim 15, wherein step (b) further comprises the step of:

operatively connecting the grip to the crossbow, wherein the grip comprises:

a quick attach member comprising a plug and a first socket; and, a ball joint mount comprising a shaft and a spherical portion, wherein the shaft can be fixedly received in the stock of the crossbow and a spherical portion rotatably received in the first socket of the quick attach member and the plug is received in a socket formed in an end of the grip.

* * * * *